US007624763B2

(12) United States Patent
Drope et al.

(10) Patent No.: US 7,624,763 B2
(45) Date of Patent: Dec. 1, 2009

(54) HEALD SHAFT HAVING A SELF-TIGHTENING LOCK

(75) Inventors: Stefan Drope, Albstadt (DE); Johannes Bruske, Albstadt (DE); Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 229 days.

(21) Appl. No.: 11/474,336

(22) Filed: Jun. 26, 2006

(65) Prior Publication Data

US 2007/0009319 A1 Jan. 11, 2007

(30) Foreign Application Priority Data

Jun. 24, 2005 (DE) ..... 10 2005 029 701

(51) Int. Cl.
*D03C 9/06* (2006.01)

(52) U.S. Cl. ..... 139/91; 139/92

(58) Field of Classification Search ..... 139/91–92, 139/82

See application file for complete search history.

(56) References Cited

U.S. PATENT DOCUMENTS 3,016,925 A * 1/1962 Graf ..... 139/92
4,022,252 A 5/1977 Ogura
4,832,088 A * 5/1989 Palau ..... 139/91
4,883,095 A * 11/1989 Maruyama et al. ..... 139/91
5,005,607 A * 4/1991 Shimizu ..... 139/91
5,411,061 A * 5/1995 Faase ..... 139/91

FOREIGN PATENT DOCUMENTS

| | | |
|---|---|---|
| CH | 446 221 | 10/1967 |
| DE | 37 39 870 | 6/1988 |
| EP | 0 314 181 | 5/1989 |
| NL | 79420 | 10/1995 |

* cited by examiner

*Primary Examiner*—Gary L Welch
*Assistant Examiner*—Andrew W Sutton
(74) *Attorney, Agent, or Firm*—Fitch, Even, Tabin & Flannery; Norman N. Kunitz

(57) ABSTRACT

In the heald shaft (1) according to the invention, a coupling device (8) is provided which serves for connecting the end binder (4) with the shaft rod (3) and which has a spring-biased clamping member (18) for frictionally holding a coupling element (20) in the shaft rod (3). When required, the clamping member (18) may be moved into its releasing position against the force of the spring element (30) for releasing the coupling element (20), so that the latter may be pulled out of the shaft rod (3) alone, or possibly together with other components of the coupling device (8). Operating such a coupling device is particularly simple and requires neither particular skill nor particular attention. The coupling device (8) is adapted for shaft rods of lightweight construction.

18 Claims, 7 Drawing Sheets

HEALD SHAFT HAVING A SELF-TIGHTENING LOCK

CROSS REFERENCE TO RELATED APPLICATION

This application claims the priority of German Patent Application No. 10 2005 029 701.3, filed on Jun. 24, 2005, the subject matter of which, in its entirety, is incorporated herein by reference.

BACKGROUND OF THE INVENTION

The invention relates to a heald shaft having a releasable end binder.

As a rule, heald shafts comprise two shaft rods which are held parallel to, and spaced from, one another by end binders. The shaft rods and the end binders together define a rectangle. To the shaft rods shaft staves are secured which support the healds. The healds have to be occasionally replaced. For such an operation at least one of the two end binders is removed, whereby the healds may be slid off the shaft staves by shifting them therealong. For effecting removal of the end binders, they are releasably coupled with the shaft rods.

German Patent Document DE 37 39 870 A1 illustrates a coupling device for connecting an end binder with a shaft rod in a web shaft. The coupling device comprises a prolongation which extends laterally away from the end binder and which extends into a cavity of the shaft rod formed as a hollow section. The prolongation is, for example, a component which has two legs which may be spread apart by an externally accessible clamping screw. The latter presses the legs against an upper and a lower web of the cavity for firmly clamping the coupling device in the cavity. In the alternative, for spreading the legs apart, a dual cam may be provided which is in engagement with respective curved follower surfaces arranged on facing sides of the legs. Upon turning the cam disposed between the legs, it spreads the legs apart for clamping the coupling device in the cavity.

Swiss Patent No. 446 221 discloses a coupling device which serves for connecting an end binder with a shaft rod and which is likewise based on cam operation. The coupling device comprises a spring element which is accommodated in the cavity and which has at least one wedge face extending at an inclination to the length direction of the shaft rod. A wedge, also disposed in the cavity, is clamped with one inclined face against the wedge face of the spring element, and is clamped with its back, for example, against a web of the shaft rod. The wedge element wedges upon imparting thereto a pulling force directed outward of the cavity. The wedge element passes through an aperture of the end binder with a prolongation acted upon by a cam provided with a lever, for generating the desired tensile force by a pivotal motion.

The two above-outlined devices are tolerance-sensitive. In case of an excess, the cam causes an excessive clamping of the coupling device. Such an occurrence is incompatible with the tendency to build shaft rods of light-weight structure. Deformations may occur if coupling devices are excessively clamped, particularly in case of light-weight shaft rods.

Further, European Published Application No. EP 0 314 181 A1 and U.S. Pat. No. 4,022,252 disclose coupling devices for interconnecting a shaft rod and an end binder, where the axially displaceable wedge of the coupling device is tightened by a tension screw. In case of sensitive heald shafts, it is necessary to tighten the screw with a torque wrench for preventing the coupling device from being excessively tightened. This requirement is occasionally neglected in practice which may result in damages.

It is therefore the object of the invention to provide an improved heald shaft.

SUMMARY OF THE INVENTION

The above object generally is achieved with the heald shaft according to the invention which includes a shaft rod and an end binder which are connected to one another by a coupling device. The coupling device comprises a clamping member supported for displacement between a clamping position and a releasing position for clamping a coupling element which is connected with the end binder. The force to be applied for moving the clamping member into, and holding it in, its clamping position, is generated by a spring element which acts on the clamping member and biases it toward its clamping position. As a result, the force which clamps down the clamping member is essentially constant or, in any event, well controlled. In this manner, on the one hand, a secure seating of the coupling device is obtained and, on the other hand, it is ensured that a maximum force imparted to the shaft rod by the coupling device is not exceeded. Particularly in case of shaft rods having very thin walls, damage to the shaft rod can thus be prevented. Neither is an excessively loose seating and thus a separation between shaft rod and end binder to be feared, nor is a torque wrench or other force or torque controlling tool required for operating the coupling device.

The clamping member is preferably a wedge element, whose displacement path is, for example, linear and which is supported for displacement preferably transversely to the end binder. In this manner, the wedge element spreads apart two elements in a direction parallel to the end binder for effecting a firm clamping of the coupling device in the receiving cavity of the shaft rod. The noted elements may be, for example, the parallel-arranged legs of a frame which accommodates the clamping member. The legs of the frame may be spread apart from one another. The spreading motion is preferably transverse to the direction of motion of the clamping elements, that is, approximately perpendicular to the pressing surfaces of the clamping elements. The frame is, for example, a plastic body which has a certain elastic deformability. The frame may further have a receiving cavity for a coupling element which is preferably unreleasibly connected to the end binder. The connection is preferably formed by a joint which allows at least a slight pivotal motion of the coupling element relative to the end binder. In about the middle of the pivotal range, the coupling element is oriented approximately perpendicularly to the end binder. The pivot axis of the joint provided between the coupling element and the end binder lies preferably within the end binder. As a result, a generation of bending moments acting on the end binder are substantially prevented. The end binder is essentially stressed for tension and pressure.

In a preferred embodiment of the coupling device several clamping members are used which are constituted, for example, by wedge elements. The clamping members are moved preferably in opposite directions for displacing them from the clamping position into the releasing position and conversely. Preferably, the clamping members are biased by one and the same spring element, such as a flexure spring. It is to be understood, however, that several, separate and differently structured spring elements may be provided for biasing the clamping members into their clamping position.

In the preferred embodiment the clamping member (or clamping members, as the case may be) is associated with a releasing device which is capable of overcoming the biasing force applied by the spring element to thus move the clamping member (or members) into the releasing position. As a releasing device, preferably a rotatably supported cam is used which is in engagement with the clamping members. By means of recesses, which are provided in the clamping elements and into which the cam locks after the cam has overcome the biasing force of the spring element, it is ensured that the position in which the coupling element can be released is maintained stable. For such a purpose a perceptible indication of such a position is obtained. The arrangement is preferably such that the spring element biases the clamping members toward one another, while, upon suitable rotation, the cam positioned between the two clamping members drives them away from one another. Such an arrangement is, however also reversible in principle.

Preferably, a detent device is arranged between the coupling element and the frame which, when the coupling element is pushed into a corresponding opening of the frame, sets a defined locked-in location. This arrangement has the advantage that a correct positioning of the end binder and the shaft rod with respect to one another may be established before the coupling device is moved into the clamping position. Then, upon clamping the coupling device, the desired correct relative position is preserved. The operating person receives a perceptible signal when the correct relative position is reached during the insertion of the coupling element into the frame disposed inside the shaft rod.

The frame, the clamping element (or elements) and, on occasion, also the coupling element may be made of plastic and, if desired, may be made in a joint manufacturing step as an interconnected component. The connection between the frame and the clamping member (or members) may be constituted by one or more, preferably flexible connecting webs.

Further details of advantageous embodiments of the invention form subject of the drawing, the description or the claims.

BRIEF DESCRIPTION OF THE DRAWINGS

In the drawing which shows embodiments of the invention.

DETAILED DESCRIPTION OF THE INVENTION

Figure 1:
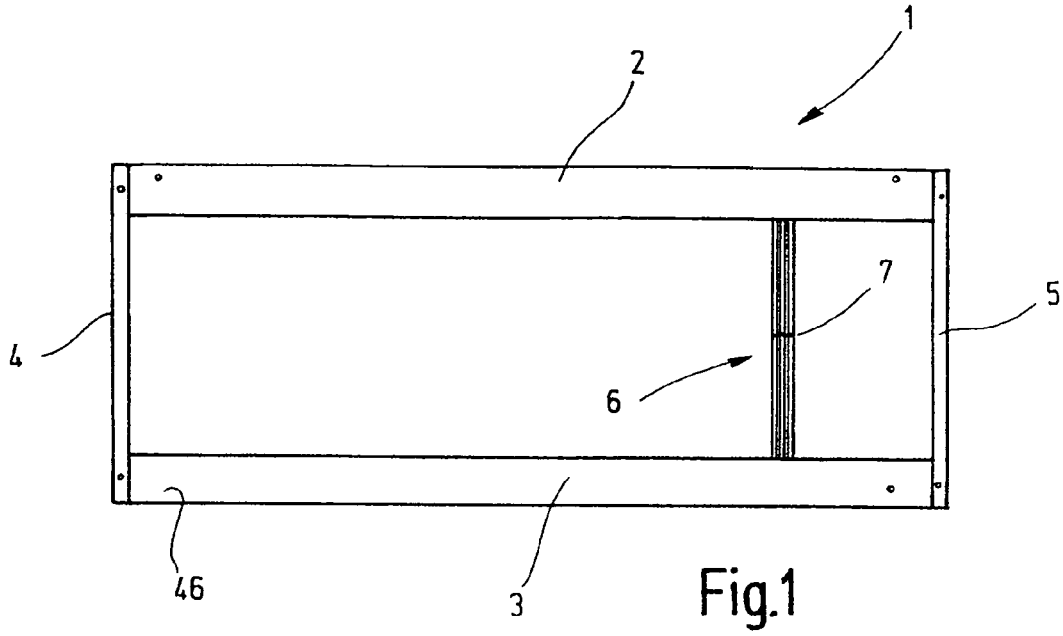
FIG. 1 is a schematic front elevation of a heald shaft.

FIG. 1 shows a heald shaft 1 comprising an upper and a lower shaft rod 2, 3 as well as end binders 4, 5 which connect the shaft rods 2, 3 with one another and which hold them in a parallel, spaced relationship. The shaft rods 2, 3 support respective shaft staves (not shown) which hold healds 6 provided with yarn eyelets 7 through which warp yarns run. The heald shaft 1 is reciprocated up and down in rapid succession for shed-forming. For various reasons, for example, for replacing the healds 6, at least one of the end binders 4, 5 has to be removed from the heald shaft 1. The connection between the end binders 4, 5 on the one hand, and the shaft rods 2, 3 on the other hand, is therefore releasably structured.

Figure 2:
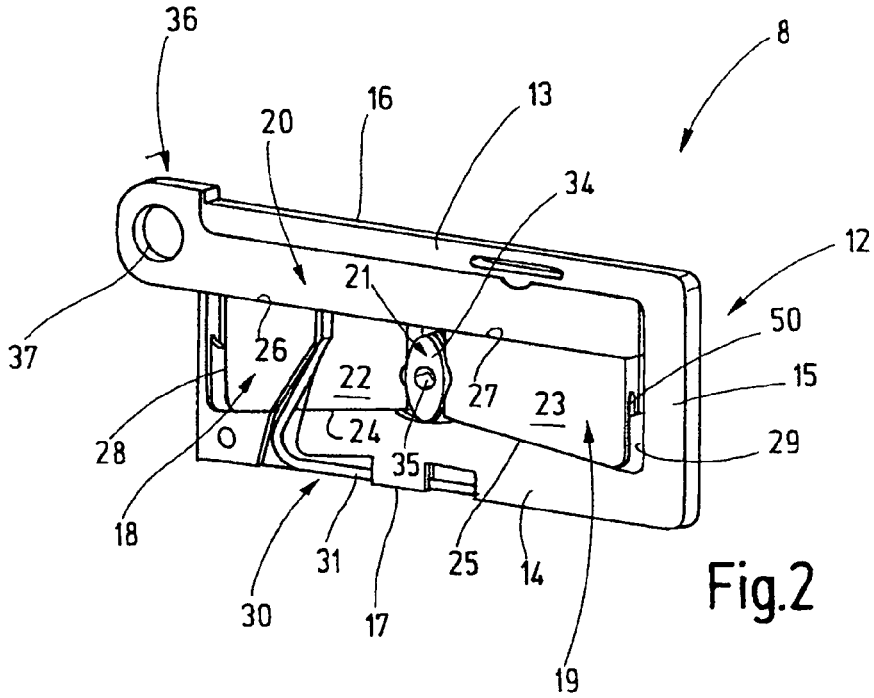
FIG. 2 is a perspective illustration of a coupling device for joining an end binder to a shaft rod of a heald shaft according to FIG. 1.
Figure 3:
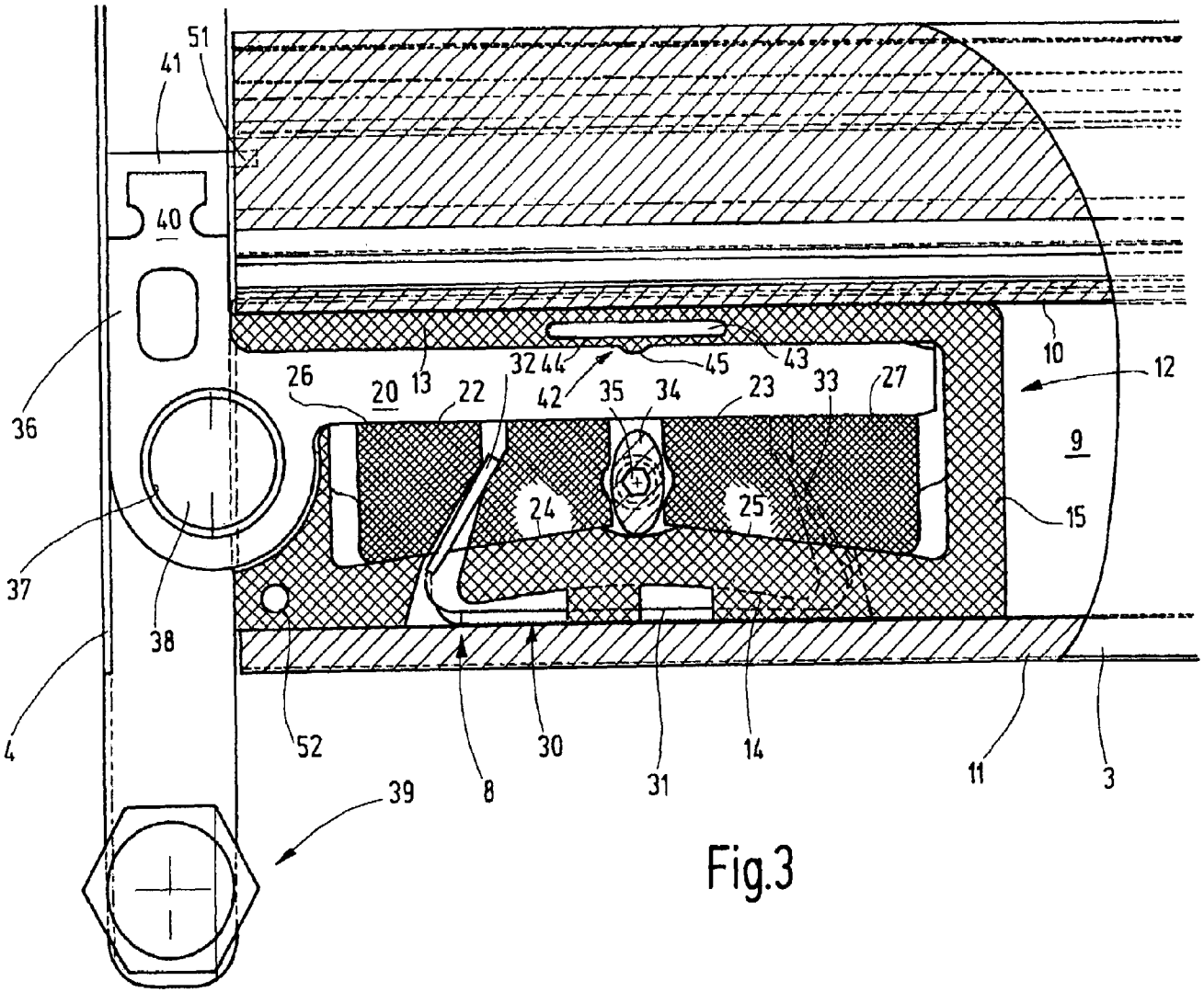
FIG. 3 is a fragmentary schematic showing, partially in section, of the end binder, the shaft rod and the coupling device.

Coupling devices are provided at all four corners as connections. In FIG. 2 the coupling device 8 is illustrated which represents all the other coupling devices and which is positioned in the lower left corner of the heald shaft 1 between the end binder 4 and the shaft rod 3. The coupling device 8 connects the end binder 8, structured as a steel sheet-metal U-section, with the shaft rod 3 which is an extruded aluminum section. The coupling device 8 is inserted in a receiving cavity 9 of the shaft rod 3, as illustrated in FIG. 3. The receiving cavity 9 has an essentially rectangular cross section and extends as a hollow space along the entire length of the shaft rod 3. As shown in FIG. 2, the cross section of the coupling device 8 is also approximately rectangular. The height of the coupling device 8, measured in the vertical direction in FIG. 2, essentially equals the distance between the webs 10, 11 of the shaft rod 3, as seen in FIG. 3.

The coupling device 8 has a frame 12 constituted by a plastic body. The frame 12 includes two legs 13, 14 which lie against the webs 10, 11 in use and which are interconnected slightly resiliently by a connecting portion 15.

The legs 13, 14 have, at their side facing the webs 10, 11, throughgoing or interrupted strip-shaped engagement surfaces 16, 17, by means of which they lie face-to-face on the webs 10, 11. The legs between themselves leave free an intermediate space for receiving at least one, but in the present embodiment two clamping members 18, 19, a coupling element 20 and a releasing device 21.

The clamping members 18, 19, as shown in FIGS. 2 and 3, are preferably wedge elements 22, 23 which have two slide surfaces oriented at an acute angle to one another. Accordingly, the contacting leg 14 is provided with a first and a second inclined surface 24, 25, respectively, which face the wedge elements 22, 23. The latter lie against the respective inclined surfaces 24, 25. The inclined surfaces 24, 25 are preferably each planar, but they may be groove-shaped or rib-shaped.

The wedge elements have a respective pressing surface 26, 27 facing the leg 13. In this manner, between the leg 13 and the wedge elements 22, 23 an intermediate space is obtained in which the coupling element 20 extends. The latter is constituted, for example, by a metal bar having a rectangular cross section that is essentially constant along its length.

The wedge elements 22, 23 are preferably of a plastic or a metal. As shown in FIG. 2, they may be provided with a longitudinal slot 50 which is parallel to their lateral flat sides and into which extend guide plates 28, 29 formed on the leg 14 or on the connecting portion 15. The guide plates 28, 29 have a thickness less than the thickness of the wedge elements 22, 23. The thickness of the wedge elements preferably essentially equals the thickness of the legs 13, 14 and that of the connecting portion 15 which, in turn, is as thick as the coupling element 20. The thickness is measured in a direction which is perpendicular to the drawing plane of FIG. 3 and thus transverse to the shaft rod 3. The thickness is so dimensioned that the frame 12 fills the receiving cavity 9 in its width.

The wedge elements 22, 23 are biased into their clamping position, that is, toward one another in the present embodiment, by a spring means which comprises at least one spring element 30. The spring element 30 is constituted by a flexion spring formed by a yoke of spring wire and has a portion 31 held in the leg 14. From the spring portion 31 extend arms 32, 33 into respective recesses of the wedge elements 22, 23 for pressing together the wedge elements 22, 23. The recesses which receive the arms 32, 33 of the spring element 30, are situated approximately on the diagonals of the wedge elements 22, 23. This recess preferably forms with the inclined surface 24, 25 an acute angle which is open toward the narrow end face of the respective wedge element 22, 23. The force with which a wedge element 22, 23 is tensioned is oriented approximately in the direction of the angle-halving line between the end face of the wedge element 22, 23 and the inclined surface 24, 25 of the leg 14, that is, in the direction of the diagonal of a wedge element 22, 23. In this manner not only is the motion of the wedge elements 22, 23 initiated, but also a holding function is generated which maintains the wedging elements 22, 23 on the inclined surfaces 24, 25 of the leg 14 in case no coupling element 20 is present in the intermediate space between the leg 13 and the pressing surfaces 26, 27.

In the alternative one or more flexion spring elements may be tensioned between the wedge elements 22, 23. Or instead, compression spring elements may be provided which, with a respective one end, are in engagement with the wedge elements 22, 23 and, with their respective other end, are in engagement with the frame 12.

A releasing device 21 is associated with the wedge elements 22, 23 for moving them into the disengaging position against the force of the spring element 30. In the present embodiment, the releasing device 21 is constituted by a cam 34 which is rotatably supported between the facing end surfaces of the wedge elements 22, 23. The cam 34 may be rotatably supported on a projection which forms part of the leg 14 and which is hidden and therefore not seen in FIG. 3. The projection has an opening 35 for allowing access for a tool, such as a hollow hexagonal wrench. The cam 34 is dimensioned in such a manner that in its position illustrated in FIG. 3 it is not in engagement with the end faces of the wedging elements 22, 23, but is at a distance therefrom. Upon turning the cam 34 through 90°, it spreads the wedge elements 22, 23 away from one another against the force of the spring element 30.

The coupling element 20 forms part of a joint which provides for an articulated connection between the end binder 4 and the shaft rod 3. The coupling element 20 has a portion 36 which extends into the end binder 4 and which has a bearing opening 37. The latter receives a bearing pin 38 which is preferably fixedly attached to the end binder 4 and which only slightly pivotally supports the coupling member 20. The bearing pin 38 defines a pivot axis for the thus-formed hinge. The pivot axis lies within the end binder 4.

As seen particularly in FIG. 3, the end binder 4 is provided at a suitable end, for example at its lower end, with a connecting device 39 for establishing a connection with a driving device. The latter is formed, for example, by a section body which is held between the two flat sides of the end binder 4 and is fixedly or rotatably supported. In the present embodiment the section body is a hexagonal section arranged as a linear continuation of the end binder 4. The force-introduction into the end binder is thus effected essentially without generating kinking or bending torques in the end binder 4. As illustrated in FIG. 2, the coupling element 20 may be a simple hinge element or, as shown in FIG. 3, it may be a two-arm lever. In the latter case, the coupling element 20 has a leg 40 which extends along the length of the end binder 4 and which, if required, may be provided at its end with a plastic body 41 serving as a buffer and limiting the pivotal motion of the coupling element 20. Further, the plastic body 41 may be provided with a prolongation 51 which extends to the stave shaft for serving as a heald stop.

The leg 13 of the frame 12 may further be provided with a detent device 42 which cooperates with the coupling element 20. The detent device 42 ensures an axial position of the coupling element 20 desired for the assembly. For example, the detent device 42 is formed by a bridge 44 which is held at both ends on the leg 13 and which is undercut by a cavity 43. The bridge 44 may carry a cam-like projection 45 which extends into a corresponding recess of the coupling element 20. Instead of a bridge, a tongue may be provided.

The coupling device described up to this point operates as follows:

FIG. 3 shows the coupling device 8 in its clamping position; the cam 34 has unblocked the clamping elements 22, 23. The spring element 30 presses the wedge elements 22, 23 to one another with its arms 32, 33. Consequently, the wedge elements 22, 23 lying against the inclined surfaces 24, 25 press with their pressing surfaces 26, 27 against the coupling element 20 which, in turn, is pushed against the leg 13. In this manner the wedge elements 22, 23 spread the legs 13, 14 apart and, at the same time, firmly clamp the coupling element 20 between the wedge elements 22, 23 and the leg 13. The legs 13, 14 find their firm seat on the webs 11, 12. As an end result, the frame 12 is frictionally firmly held between the webs 11, 12. Similarly, the coupling element 20 is frictionally held between the leg 13 and the wedge elements 22, 23. The clamping force is determined and limited by the spring element 30 and is dimensioned in such a manner that, on the one hand, a sufficiently secure frictional connection is obtained between the end binder 4 and the shaft rod 3 by means of the coupling device 8 and, on the other hand, no deformation of the shaft rod 3 takes place.

A pulling or pressing force acting on the coupling element 20 along the shaft rod 3 cannot draw out the coupling element 20 from the frame 12, because in both directions either the wedge element 22 or the wedge element 23 is further tightened if there is a danger that such an axial motion could occur. Preferably, the clamping forces are, however, so dimensioned that the possibility of an axial motion of the coupling element 20 by forces generated during the operation of the heald shaft 1 is excluded in any event.

For releasing the coupling-device 8, the cam 34 is turned to a suitable extent, such as 90°, for example, through an opening 46 (FIG. 1) which is provided in the shaft rod 3 and which is in alignment with the opening 35. For securing such a rotary position which is unstable by itself, the end surfaces of the wedge elements 22, 23 may be provided with respective detent recesses 53 into which then the cam 34 penetrates. Such an arrangement ensures that the position in which the coupling element 20 may be released, is maintained in a stable condition. Further, for such a position a perceptible indication is obtained. Upon rotation, the cam 34 spreads the wedge elements 22, 23 away from one another against the force of the spring element 30 and holds the wedge elements 22, 23 in their spread-out position, whereby the coupling element 20 is unblocked and may be pulled out of the frame 12 without any appreciable resistance. Merely the rather slight detent force of the detent device 42 has to be overcome. If required, the frame 12 too, may be pulled out of the receiving cavity 9. The end binder 4 is separated from the shaft rod 3 by withdrawing the coupling element 20 from the frame 12 or by withdrawing the frame 12 from the receiving cavity 9.

The frame 12 may be optionally releasably connected with the shaft rod 3 by a connecting means 52 for ensuring that upon disassembling the end binder, the coupling element 20 is removed from the frame 12, while the latter remains in the receiving cavity 9. The frame 12 may be connected with the shaft rod 3, for example by a tensioning pin or other known types of connection.

For reconnecting the end binder 4 with the shaft rod 3, the coupling element 20 is introduced into the frame 12 disposed in the receiving cavity 9. During this occurrence the operating person feels a perceptible detent effect as the projection 45 of the detent device 42 locks into the associated recess of the coupling element 20. In this manner the operator knows that the end binder 4 and the shaft rod 3 assumed the correct position with respect to one another. Thereafter the operator inserts a suitable tool into the opening 35 and turns the cam 34 approximately 90°, whereby the wedge elements 22, 23 are set free which are then moved to one another under the effect of the spring element 30 and firmly clamp the coupling element 20 in the frame 12 and, at the same time, the frame 12 in the receiving cavity 9.

The cam 34 does not have to form part of the coupling device 8. For releasing the coupling element 20, it is also feasible to spread the wedging elements 22, 23 apart by a suitable tool. For example, a cam may be formed directly on the tool or may be a part thereof. Such an arrangement has the advantage that the coupling element 20 is securely tightened if no tool is introduced into the coupling device 8.

Figure 4:
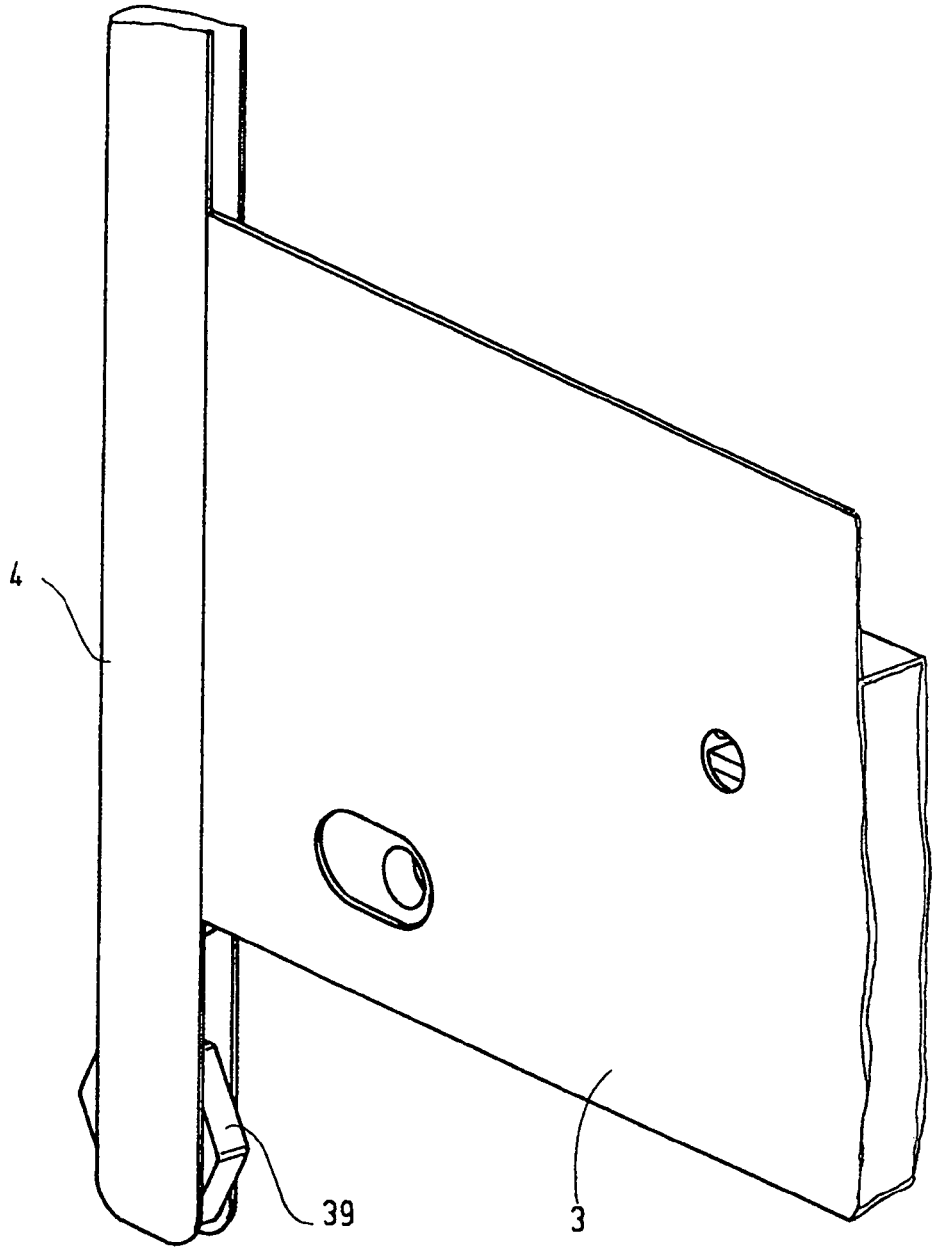
FIG. 4 is a fragmentary perspective illustration of a shaft rod and an end binder of a modified embodiment of a heald shaft.
Figure 5:
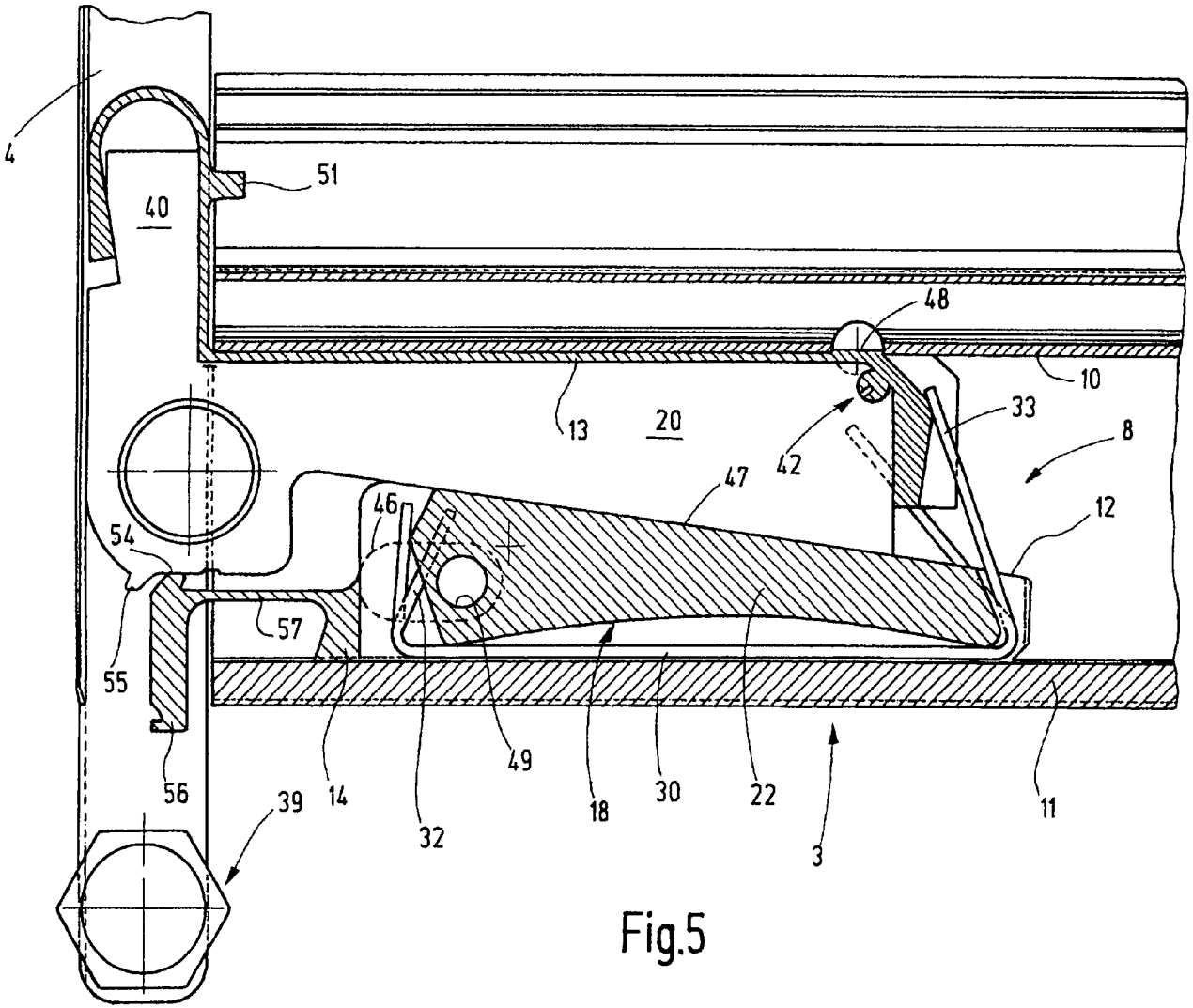
FIG. 5 is a fragmentary sectional view of a modified embodiment of the end binder and the shaft rod, together with the coupling device.

FIGS. 4 and 5 show a modified embodiment of the coupling device 8 while using the same reference characters as those which were introduced in the description of the embodiment according to FIGS. 1-3 and which in case of the embodiment of FIGS. 4 and 5 have the same or analogous meaning. Therefore, the preceding description applies with the exception of features to be set forth below.

The coupling element 20 of FIGS. 4 and 5 has a trapezoidal shape unlike the coupling element 20 of FIGS. 1-3 which has parallel flanks (that is, rectangular in a side view). Also, but a single wedge element 22 is provided. which, with its wedge surface, is supported on an inclined surface 47 of the coupling element 20. The frame 12 has, in this embodiment too, two legs 13, 14 which are significantly more slender and between which the wedge element 22 and the coupling element 20 are disposed. The spring element 30 presses with an arm 32 against the wedge element 22, while it is supported at its other arm 33 by the coupling element 20. The leg 13 of the frame 12 is now firmly connected with the coupling element 20 by the detent means 42 and is separated from the rest of the frame 12. Further, on the leg 13 a detent projection 48 is formed which extends into a corresponding recess provided in the leg 10 for determining and securing the axial position of the coupling element 20.

For operating the wedge element 22, that is, for placing it into its releasing position, the opening 46 of the shaft rod 3 is shaped a slot. A tool may be introduced through the slot into an opening 49 provided in the wedge element 22 for moving the wedge element 22 into its releasing position. During such an occurrence, the wedge element 22 abuts the leg 14 and slightly pushes it out of the shaft rod 3. At the same time, a lug 54 formed on the leg 14 locks behind a projection 55 of the coupling element. The wedge element 22 is movable only to a limited extent toward the leg 14. Consequently, the wedge element 22, disposed in a pocket of the leg 14 and thus situated in the frame 12, may no longer slide back into its clamping position; rather, it remains in its releasing position. In case the wedge element is to clamp anew, the detent connection between the lug 54 and the projection 55 is unlocked by actuating the prolongation 56 against the force of a flexible connecting web 57 situated between the lug 54 or the prolongation 56 and the leg 14.

Figure 6:
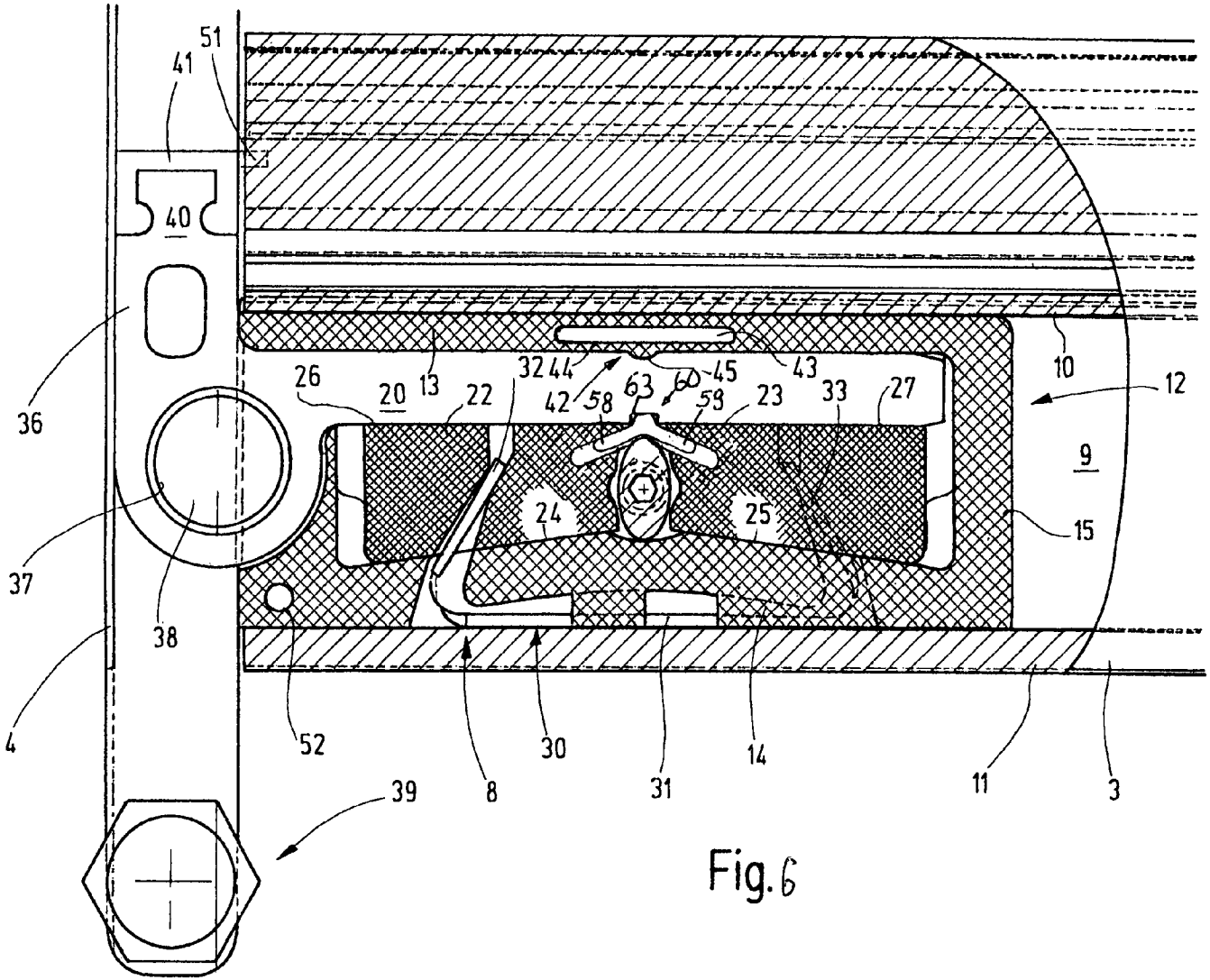
FIG. 6 is a schematic, fragmentary, partially sectional view of a modified embodiment of the end binder and the shaft rod, together with the coupling device, illustrating a clamping position.
Figure 7:
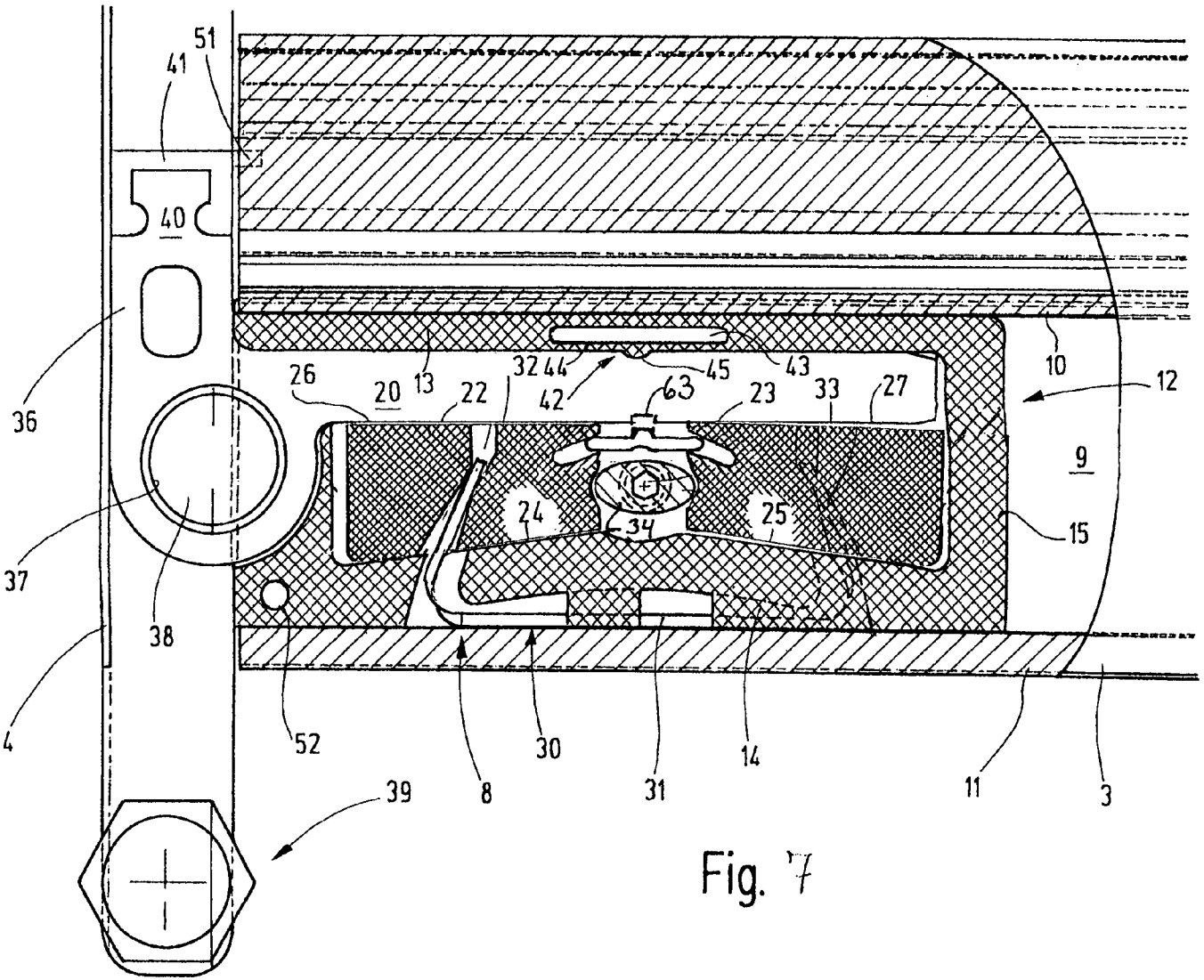
FIG. 7 shows the end binder, the shaft rod and the coupling device of FIG. 6 in a releasing position.

FIGS. 6 and 7 illustrate a modified embodiment of the coupling device 8 which agrees to a large degree with the coupling device 8 of FIG. 3. Accordingly, the description pertaining to FIG. 3 also applies to FIGS. 6 and 7. In addition, the wedge elements 22, 23 have, at their narrow end surfaces oriented to one another and preferably slightly above the rotary axis of the cam 34, slot-like recesses into which the legs 58, 59 of a locking member 60 extend. The recesses are oriented preferably at an obtuse angle to one another. Further, the wedge elements 22, 23 are, at least at their end faces, provided with a slot in a plane which is perpendicular to the rotary axis of the cam 34. The slot serves for receiving a central web 61 which is shown separately in FIG. 8, together with the locking member 60. The central web 61 made of plastic or metal, extends into both wedge elements 22, 23 and holds them captive.

Figure 8:
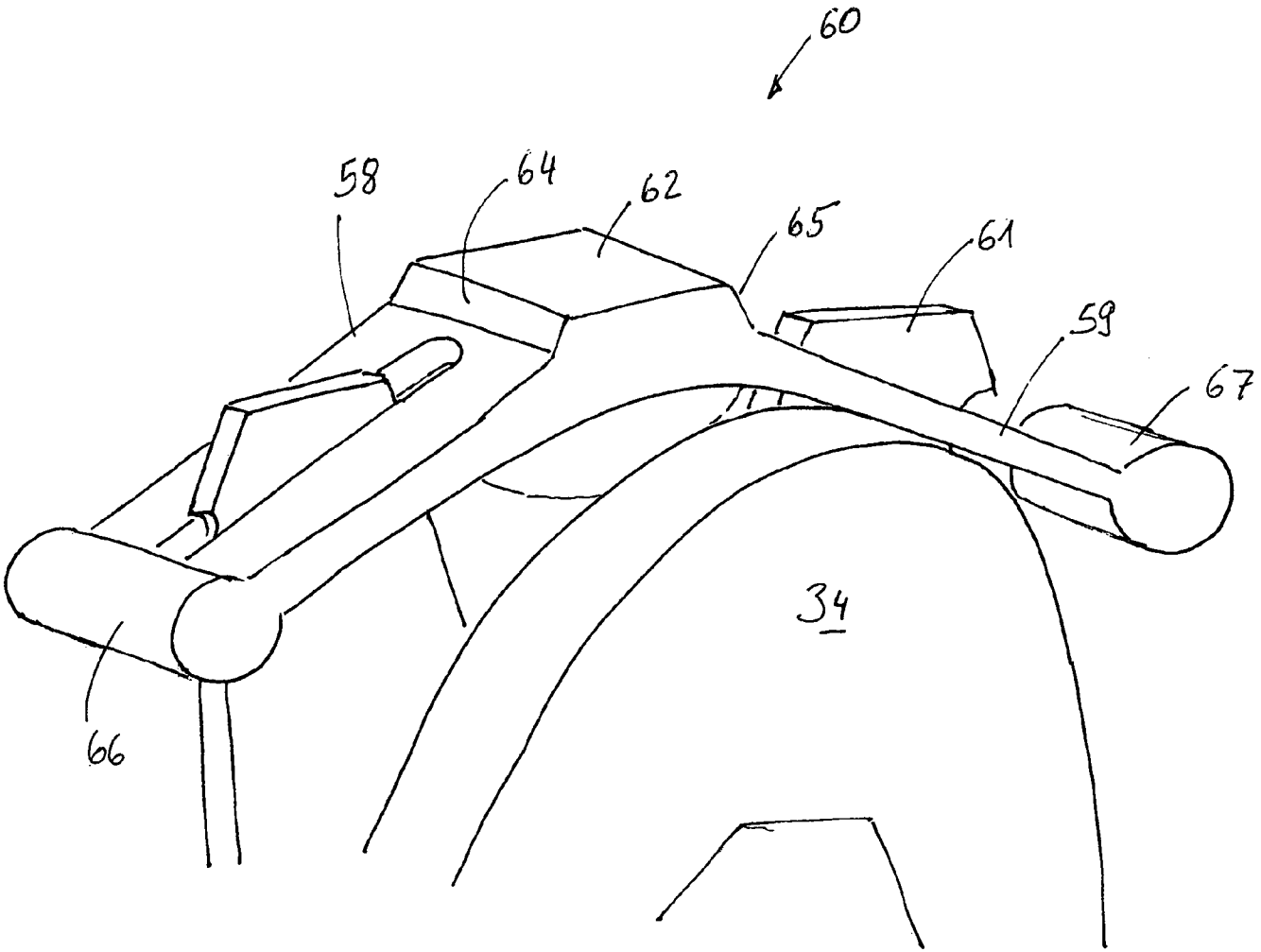
FIG. 8 is an enlarged fragmentary view of the coupling device of FIG. 6.

The locking member 60 is, for example, a plastic part and has, as shown in FIG. 8, a lug 62 which faces away from the cam 34 and which cooperates with a detent recess 63 formed in the coupling element 20. The lug 62 has, for example, a trapezoidal longitudinal cross section and has detent surfaces 64, 65 which are oriented at an acute angle to the direction of displacement of the coupling element 20. The resilient legs 58, 59 extend, at an obtuse angle to one another, away from the portion of the locking member 60 carrying the lug 62. Roller-shaped bearing portions 66, 67 may be formed at the ends of the legs 58, 59 integrally therewith. Between the bearing portions 66, 67 and the central, lug-carrying portion slots may be provided which are traversed by legs of the central web for holding captive the locking member 60 on the coupling device 8.

The cam 34 is preferably divided in two parts, wherein the respective cam half is associated with a respective side of the central web.

The locking member 60 has, at its side oriented toward the cam 34, an arcuate contour which follows the circle described by the cam. In its relaxed state the locking member 60 engages the wedge elements 22, 23 with both legs 58, 59 and projects with its lug 62 into the path of the coupling element 20. In case the cam 34 is in its releasing position, and the coupling element 20 is shifted into the coupling device 8, the coupling element 20 first pushes the lug 62 aside. Then the lug 62 perceptively locks into the detent recess 63 when the coupling element 20 is shifted into its coupling position. The operating person feels and hears the lock-in engagement of the lug 62.

Thereafter the cam 34 is moved into its clamping position. It releases the wedge elements 22, 23 which are then moved toward one another under the effect of the spring element 30 and frictionally tighten the coupling element 20. At the same time, the cam 34 assumes its position under the lug 62 and secures the latter in its detent position so that it cannot be forced out of the detent recess 63. In this manner the coupling element 20 is secured with a form fit in its coupling position.

If the cam 34 is rotated through 90°, it spreads the wedges and releases the locking member 60. The coupling element 20 may then be moved out of its coupling position, while the lug 62 of the locking member 60 moves resiliently out of the detent recess 63.

In the heald shaft 1 according to the invention, a coupling device 8 is provided which serves for connecting the end binder 4 with the shaft rod 3 and which has a spring-biased clamping member 18 for frictionally holding a coupling element 20 in the shaft rod 3. When required, the clamping member 18 may be moved into its releasing position against the force of the spring element 30 for releasing the coupling element 20, so that the latter may be pulled out of the shaft rod 3 alone, or possibly together with other components of the coupling device 8. Operating such a coupling device is particularly simple and requires neither particular skill nor particular attention. The coupling device 8 is adapted for shaft rods of lightweight construction.

LIST OF REFERENCE CHARACTERS

| | |
|---|---|
| 1 | heald shaft |
| 2, 3 | shaft rods |
| 4, 5 | end binders |
| 6 | healds |
| 7 | yarn eyelet |
| 8 | coupling device |
| 9 | receiving cavity |
| 10, 11 | webs |
| 12 | frame |
| 13, 14 | legs |
| 15 | connecting portion |
| 16, 17 | engagement surfaces |
| 18, 19 | clamping members |
| 20 | coupling element |
| 21 | releasing device |
| 22, 23 | wedge elements |
| 24, 25 | inclined surfaces |
| 26, 27 | pressing surfaces |
| 28, 29 | guide plates |
| 30 | spring element |
| 31 | portion |
| 32, 33 | arms |
| 34 | cam |
| 35 | opening |
| 36 | portion |
| 37 | bearing opening |
| 38 | bearing pin |
| 39 | connecting device |
| 40 | leg |
| 41 | plastic body |
| 42 | detent device |
| 43 | cavity |
| 44 | bridge |
| 45 | projection |
| 46 | opening |
| 47 | inclined surface |
| 48 | detent projection |
| 49 | opening |
| 50 | longitudinal slot |
| 51 | prolongation |
| 52 | connecting means |
| 53 | recess |
| 54 | lug |
| 55 | projection |
| 56 | prolongation |
| 57 | connecting web |
| 58, 59 | legs |
| 60 | locking member |
| 61 | central web |
| 62 | lug |
| 63 | detent recess |
| 64, 65 | detent surfaces |
| 66, 67 | bearing portions |

The invention claimed is:

1. A heald shaft comprising:

a shaft rod having a receiving cavity at one end, an end binder to be connected with the shaft rod, a coupling device for connecting the one end of the shaft rod with one end of the end binder, wherein the coupling device includes a wedge element clamping member supported in the receiving cavity for displacement in a longitudinal direction of the shaft rod between a clamping position and a releasing position for clamping, in the receiving cavity, a coupling element connected with the one end of the end binder, wherein the clamping member is biased toward the clamping position exclusively by a force generated by a spring disposed in the cavity and is retained in the clamping position by the force of the spring, and wherein a releasing device is associated with the clamping member, with the releasing device being a rotatably supported cam.

2. The heald shaft as defined in claim 1, wherein the clamping member is supported for lateral movement transversely to the longitudinal direction of the end binder.

3. A heald shaft comprising:

a shaft rod having a receiving cavity at one end, an end binder to be connected with the shaft rod, a coupling device for connecting the one end of the shaft rod with one end of the end binder, wherein the coupling device includes a wedge element clamping member supported in the receiving cavity for displacement in a longitudinal direction of the shaft rod between a clamping position and a releasing position for clamping, in the receiving cavity, a coupling element connected with the one end of the end binder, wherein the clamping member is biased toward the clamping position exclusively by a force generated by a spring disposed in the cavity and is retained in the clamping position by the force of the spring, and wherein the coupling device further includes a frame in which the clamping member is supported and which has two, substantially parallel-oriented legs between which the clamping member is held and which can be spread away from one another transversely to the direction of motion of the clamping member.

4. The heald shaft as defined in claim 3, wherein the legs are connected with one another by an elastically deformable connecting portion.

5. The heald shaft as defined in claim 1, wherein the coupling device has several clamping members.

6. The heald shaft as defined in claim 5, wherein each clamping member is a respective wedge element.

7. The heald shaft as defined in claim 6, wherein the respective wedge elements are movable into the clamping position and the releasing position in directions opposite to one another.

8. The heald shaft as defined in claim 1, wherein the spring comprises a flexion spring which engages the wedge element with at least one arm.

9. The heald shaft as defined in claim 8, wherein the spring generates a force component which presses the wedge element against an inclined surface.

10. The heald shaft as defined in claim 1, wherein the spring includes several spring elements.

11. The heald shaft as defined in claim 1, wherein the cam may be moved into engagement with an end face which is oriented transversely to the direction of movement of the clamping member.

12. The heald shaft as defined in claim 11, wherein the end face of the clamping member has a recess into which the cam may lock.

13. The heald shaft as defined in claim 3, wherein the coupling element is connected with the frame by a detent device.

14. The heald shaft as defined in claim 1, wherein the coupling element is jointedly connected with the end binder.

15. The heald shaft as defined in claim 3, wherein: the coupling element is connected with the end binder via a pivotal joint; and wherein, on the frame at least one engagement surface is formed for the end binder for limiting the pivot angle thereof.

16. The heald shaft as defined in claim 3, wherein the frame is releasably connected with the shaft rod by a connecting means.

17. The heald shaft as defined in claim 1, wherein a locking member is associated with the coupling element.

18. The heald shaft as defined in claim 17, wherein: the locking member is actuated by the cam.

* * * * *